United States Patent [19]

Barnes

[11] Patent Number: 5,027,471

[45] Date of Patent: Jul. 2, 1991

[54] DOOR PROP

[76] Inventor: Larry Barnes, 344 Main St., Apt. D, Imperial, Pa. 15126

[21] Appl. No.: 560,806

[22] Filed: Jul. 31, 1990

[51] Int. Cl.[5] ..... E05F 5/04

[52] U.S. Cl. ..... 16/86 R; 16/82; 16/374; 292/288

[58] Field of Search ..... 16/82, 319, 374, DIG. 17, 16/86 R, 86 B, 86 A, 83, 223, 353, 375; 292/288, 343

[56] References Cited

U.S. PATENT DOCUMENTS

| | | | |
|---|---|---|---|
| 83,967 | 11/1868 | Horrell | 16/82 |
| 377,852 | 2/1888 | Giesy | 16/86 A |
| 1,616,265 | 2/1927 | Kroehling | 292/288 |
| 1,944,101 | 1/1934 | Meier | 16/86 A |
| 2,592,230 | 4/1952 | Allen | 16/82 |
| 3,325,854 | 6/1967 | Steigerwald | 16/86 B |
| 4,648,152 | 3/1987 | Grewall | 16/82 |
| 4,738,002 | 4/1988 | Shank | 16/82 |
| 4,831,688 | 5/1989 | Deininger | 16/82 |
| 4,858,273 | 8/1989 | Civitelli | 16/86 B |

FOREIGN PATENT DOCUMENTS

| | | | |
|---|---|---|---|
| 2594880 | 8/1987 | France | 16/319 |
| 323152 | 2/1936 | Italy | 16/374 |

*Primary Examiner*—Richard K. Seidel
*Assistant Examiner*—Edward A. Brown
*Attorney, Agent, or Firm*—Clifford A. Poff

[57] ABSTRACT

A door prop device for the purpose of maintaining a hinged door in a propped-open position against the forces of spring tension, wind, gravity, or other causes, which will effectively function without damaging either the door or any adjacent structure and which will function on doors which pivot on vertical axes, horizontal axes, or any pivot axes orientations between vertical and horizontal. The device comprises a block-shaped prop member and a retainer member attached to the prop member. The retainer member is adapted to be placed over and engage with a hinge pin of an opened door hinge whereby the prop member is caused to assume an obstructing position in the space between the separated plates of the opened hinge. When it is desired to close the door, the door prop device is simply removed from the hinge and the door may then be closed.

9 Claims, 2 Drawing Sheets

DOOR PROP

BACKGROUND OF THE INVENTION

1. Field of the Invention

The present invention relates generally to devices for propping-open doors and, more particularly, to a device which is releasably engageable with a conventional butt door hinge for maintaining the door in a propped-open position.

2. Description of the Prior Art

There are a number of situations which require that a hinged door be maintained, at least temporarily, in a propped-open position. These situations may include, inter alia, child safety and/or observation, room ventilation, room cleaning in hotels, motels and hospitals, and furniture moving. Floor-supported wedge type devices for the purpose of propping-open hinged doors that would otherwise close due to spring tension, wind, gravity, or other causes, are known in the prior art.

In instances where the floor surface is slippery or the floor to door bottom height is irregular, a wedge type door stop may have to be repeatedly readjusted or may even be impossible to use. Furthermore, such devices commonly cause damage to the bottoms of laminated doors as well as scuffing and/or scratching of floor surfaces.

An advantage exists, therefore, for a door prop device which will enable a hinged door to be maintained in a propped-open position without damaging either the door or the floor, and which will properly function irrespective of the slipperiness of the floor and the spacing between the door bottom and the floor.

Another advantage exists for a door prop device which will function on doors which pivot on vertical axes, horizontal axes or any axes orientations between vertical and horizontal.

A further advantage exists for a door prop device which is rugged in construction, inexpensive to manufacture, and simple to use.

It is, therefore, an object of the present invention to provide a door prop device which will enable a hinged door to be maintained in a propped-open position without damaging either the door or the floor, and which will properly function irrespective of the slipperiness of the floor and the spacing between the door bottom and the floor.

It is another object of the present invention to provide a door prop device which will function on doors which pivot on vertical axes, horizontal axes, or any axes orientation between vertical and horizontal.

It is a further object of the present invention to provide a door prop device which is rugged in construction, inexpensive to manufacture, and simple to use.

Still other objects and advantages will become apparent in light of the attached drawings and written description of the invention presented hereinbelow.

SUMMARY OF THE INVENTION

For the purpose of maintaining a hinged door in a propped-open position against the forces of spring tension, wind, gravity, or other causes, there is provided a door prop device which will effectively function without damaging either the door or any adjacent structure and which will function on doors which pivot on vertical axes, horizontal axes, or any axes orientations between vertical and horizontal. The device comprises a blockshaped prop member and a retainer member attached to the prop member. The retainer member is adapted to be placed over and engage with a hinge pin of an opened door hinge whereby the block is caused to assume an obstructing position in the space between the separated plates of the hinge. When it is desired to close the door, the door prop device is simply removed from the hinge and the door may then be closed.

DESCRIPTION OF THE PREFERRED EMBODIMENTS

Figure 1:
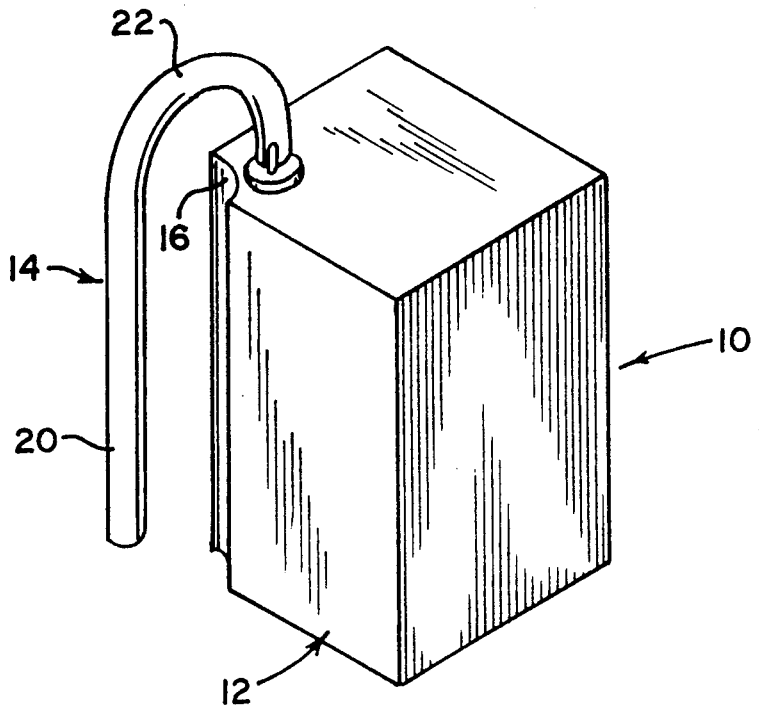
FIG. 1 is a perspective view of a first embodiment of the door prop device of the present invention.

In FIG. 1 there is seen in perspective a first embodiment of a door prop device 10 constructed in accordance with the present invention. Door prop device 10 includes a prop member 12 with a retainer member 14 attached thereto. As will be described hereinbelow, the retainer member 14 may be either fixedly or releasably attached to prop member 12.

Prop member 12 of FIG. 1 is shaped generally as a rectangular block or prism. Typical dimensions for the prop member may be about 2½ inches on a side and about 3 inches in height. However, reference to FIGS. 2 and 4 to be described hereinafter evidence that the prop member 12 may assume radically different shapes and dimensions so long as it effectively performs its function of preventing an opened door from closing beyond a desired minimum angular position relative to the frame to which it is hingedly mounted. Furthermore, the prop member 12 may be fabricated of virtually any rugged material including plated metal, metal alloy, fiberglass, rubber, wood, and the like, so long as the material is rugged and resistant to permanent deformation. In instances wherein a door to be propped-open through use of the door prop device 10 is expected to be subjected to potentially sudden and violent closing forces, such as, for example, high and/or gusty winds, it is preferred that the prop member be formed of relatively yieldable and resilient material in order to avoid damage to itself, the door, and the door frame structure. However, under most "normal" use conditions, high-impact injection molded plastic is preferred due to its relatively low manufacturing cost, its durability and its ability to be pigmented to match or blend with any room, door or door frame color.

A concave groove 16 is formed at one corner and extends for the full height of the prop member 12. As is best seen in FIGS. 3 and 4, the radius of curvature of the groove 16 is slightly greater than the radius of curvature of the central cylindrical joint of the hinge in order to accommodate the same at such time when the prop member 12 is seated in a preferred obstructing position between the separated plates of the door hinge.

In accordance with the present invention, the retainer member 14 is preferably an inverted substantially U-shaped rod or tube having a first leg 18 attached to the prop member 12 and a free second leg 20, the first and second legs being joined by a central portion 22. The depth of central portion 22 establishes the location of the obstructing position of the prop member 12 between the door and the frame, which, as noted hereinabove, is most preferably between the separated plates of the door hinge since such a position minimizes potential cosmetic damage to the door or frame which may be caused by the prop member. Being so constructed, the retainer member 14 serves as a hook-like hanger member for enabling the door prop device to be easily placed on and removed from a hinge in a manner to be described hereinbelow. In addition, the retainer member 14 permits the door to be opened to an angle wider than that formed between the sides of the prop member which contact the door and the frame without the device falling from its obstructing position. Therefore, replacement of the device each time the door is widely opened is avoided.

Figure 2:
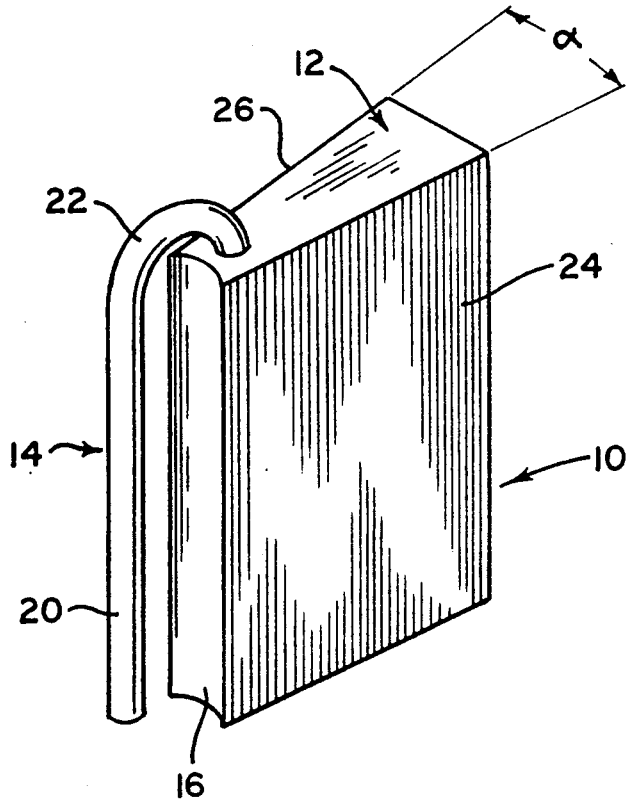
FIG. 2 is a perspective view of a second embodiment of the door prop device of the present invention.

Turning to FIG. 2, wherein like references indicate similar elements, as is true in the remaining views, it is seen that the prop member may assume a shape other than rectangular. In this particular embodiment, the prop member 12 assumes the shape of a substantially triangular or wedge-shaped block having opposed sidewalls 24 and 26 diverging from concave surface 16 at an angle $\alpha$, thereby imparting the wedge shape to the prop member. While angle $\alpha$ is illustrated as an acute angle in the door prop device 10 of FIGS. 2 and 4, it will be understood that angle $\alpha$ may be either an acute angle, a right angle ( such as in FIG. 1), or an obtuse angle depending on the degree to which it is desired to prop open a door. Moreover, the sidewalls 24 and 26 as manufactured may be shaved, sanded or otherwise trimmed by the user to reduce the angle $\alpha$ to any desired prop angle. And, for optimum performance and ease of use, the retainer member should, at all times, including after trimming of sidewalls 24 and 26, lie within a plane bisecting angle $\alpha$.

Figure 3:
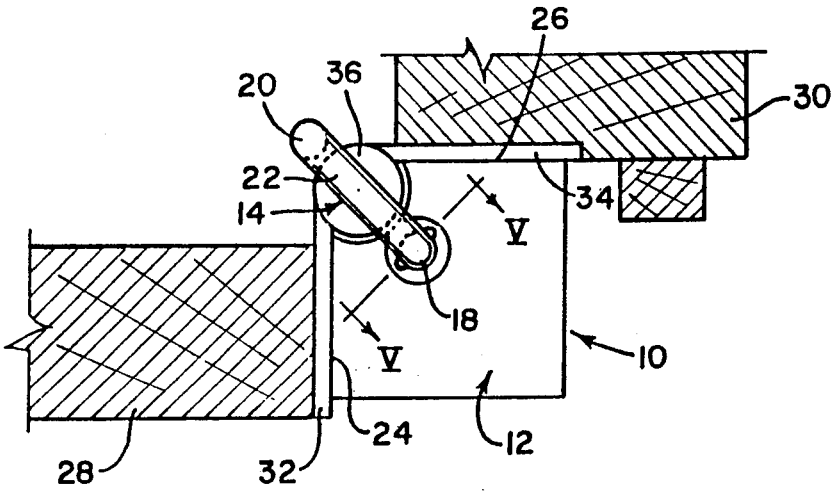
FIG. 3 is a view of the first embodiment of the door prop device seated in an obstructing position in an opened door hinge.
Figure 4:
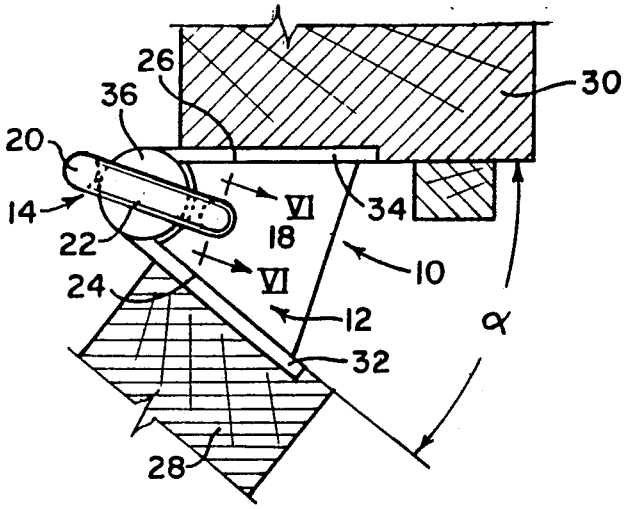
FIG. 4 is a view of the second embodiment of the door prop device of the present invention seated in an obstructing position in an opened door hinge.

FIGS. 3 and 4 depict the proper positioning of the door prop device 10 of the present invention between the plates of a hinge which pivotally connects a door 28 to its frame structure 30. The door 28 may be a door which pivots on a vertical hinge axis, a horizontal hinge axis, or any hinge axis orientation between vertical and horizontal. For purposes of most clearly expressing the novel structure, usage, and advantages of the door prop device according to the present invention, however, the door 28 will be assumed to be any door that is biased to automatically close, e.g., by spring tension, gravity or other forces.

To use the door prop device 10, the door 28 is first opened to a position whereat hinge plates 32 and 34 attached to door 28 and frame structure 30, respectively, are separated by some angle greater than $\alpha$. The free leg 20 of the retainer member 14 is inserted in the space between the door and the frame structure and then slid into position until the underside of the central portion 22 engages with the end of the hinge joint, as at the top of a hinge pin 36, for example, whereupon the prop member 12 is seated in an obstructing position between hinge plates 32 and 34. The door is then released whereby its biasing force causes hinge plates 32 and 34 to come into abutment with sidewalls 24 and 26, respectively, hence maintaining the door 28 in a propped-open position.

For optimum stability, it is preferred that free leg 20 be of sufficient length to extend along a substantial portion of the length of the hinge joint and that the spacing between the free leg 20 and concave surface 16 be just slightly greater than the maximum radial dimension of the hinge joint. With such a design, the possibility of improper placement of the door prop device 10 on the hinge joint is essentially eliminated and thus the potential for damage to the door 28, the frame 30, and/or the door prop device is minimized when the door is closed upon the device.

Figure 5:
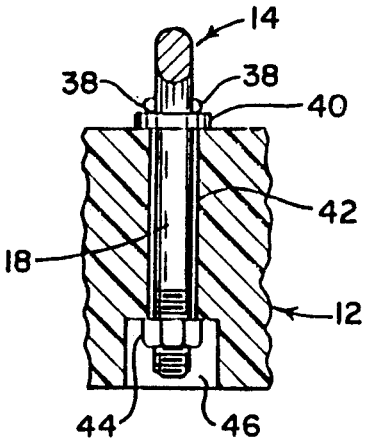
FIG. 5 is a partial sectional view taken along line V—V of FIG. 3 illustrating a first preferred manner of attaching the retainer member to the block-shaped prop member of the door prop device of the present invention.
Figure 6:
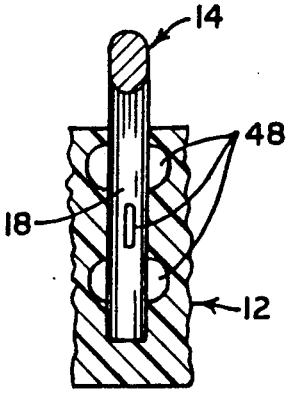
FIG. 6 is a partial sectional view taken along line VI—VI of FIG. 4 illustrating a second preferred manner of attaching the retainer member to the block-shaped prop member of the present invention.

FIGS. 5 and 6 show two contemplated constructions for attaching the retainer member 14 to the prop member 12. Turning first to FIG. 5 it is seen that leg 18 of retainer member 14 is threaded at its distal end and is provided near central portion 22 with laterally projecting stop means 38 formed, for example, by crimping. Therefore, to attach the retainer member 14 to the prop member 12 in the manner shown in FIG. 5, the threaded end of leg 18 is passed through a washer 40 until stop means 38 contact the washer, the leg 18 is then inserted into a leg-receiving bore 42 in prop member 12 and a nut 44 is threaded and tightened onto the threaded end of leg 18 in a counterbored region 46 of the prop member. Consequently, if for any reason either the retainer member or the prop member become damaged beyond serviceable condition, either can be quickly replaced by reason of the releasable attachment depicted in FIG. 5.

FIG. 6, on the other hand, illustrates a condition in which the retainer member 14 is fixedly attached to the prop member 12. In this embodiment, the retainer member 14 is embedded in the prop member 12 during molding thereof and is preferably provided with radially-projecting anchor means 48 to further ensure its permanent retention within the material forming prop member 12.

The releasable attachment structure of FIG. 5 and the permanent attachment structure of FIG. 6 are provided merely for purposes of illustration. Other means may be equally well suited for releasably or fixedly attaching the retainer member 14 to the prop member 12. Moreover, while the releasable attachment structure of FIG. 5 is shown in use with the embodiment of the door prop device depicted in FIGS. 1 and 3, it will be understood that such releasable attachment structure, or its equivalent, may be used in conjunction with a door prop member having the general shape of that shown in FIGS. 2 and 4 or in any other door prop member limited by the claims of the present invention. Similarly, although shown in use with the embodiment of the door prop device represented in FIGS. 2 and 4, the fixed attachment structure exemplified in FIG. 6, or its equivalent, may be used in conjunction with any embodiment of the door prop member 12 defined by the claims appended hereto.

A number of benefits and advantages arise by virtue of the unique construction of the door prop device of the present invention, the major ones of which may be summarized as follows:

1) the door prop device is non-damaging to the door, the door frame or any adjacent structure, e.g., a floor;

2) it can be sized and shaped to be of use with any size door hinge or to maintain a door propped-open in virtually any desired angle up to about 180° relative to its frame structure;

3) it can be used on hinges of any angular orientation;

4) when used with conventional doorways in which a door pivots on at least two vertically spaced apart hinges having vertically extending hinge axes, it can be placed on any of the hinges, i.e., top, middle (if present), or bottom, whereby it can be easily placed in a lower hinge by a handicapped individual or it can be placed in the top hinge by an adult to prevent removal of the door prop device by a small child;

5) it can be formed of an assortment of materials depending upon the conditions under which it is intended to be used and it can be custom trimmed to desired size by the user;

6) although essentially unobtrusive, it can be manufactured to match or blend with any room, door, or door frame color; and 7) by virtue of the retainer member 14, it permits the door to be opened beyond angle $\alpha$ without the device falling from its obstructing position, thereby avoiding replacement of the device each time the door is opened to an angle wider than $\alpha$.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A door prop device for use in a construction wherein a door is pivotally attached to a frame by a hinge, said door prop device comprising:

a door prop member removably placeable into an obstructing position between opposed plates of said hinge, said prop member including a concave groove formed at a corner thereof, said groove extending for the full height of said prop member and adapted for accommodating a central joint of said hinge when said prop member is placed into the obstructing position between the opposed plates of said hinge; and means attached to said door prop member and engageable with said hinge for retaining said door prop member in said obstructing position when said door prop member is placed into said obstructing position, the means for retaining said door prop member in said obstructing position including a first leg attached to said door prop member, a second free leg, and means connecting said first and second legs for establishing said obstructing position.

2. The device of claim 1 wherein the spacing between the second free leg of the means for retaining and said concave groove is slightly greater than a maximum radial dimension of said hinge joint whereby said central hinge joint is closely receivable between said groove and said second free leg, said second free leg further being adapted for insertion between said frame and said door and slidable along said hinge joint until an end of said hinge joint contacts said means connecting said first and second legs, thereby establishing said obstructing position.

3. The device of claim 2 wherein said second free leg is substantially equal to the length of said hinge.

4. The device of claim 3 wherein sidewalls of said prop member on opposite sides of said concave groove diverge from said concave groove at a predetermined angle.

5. The device of claim 4 wherein the means for retaining lies in a plane bisecting said predetermined angle.

6. The device of claim 1 wherein the means for retaining is releasably attached to said door prop member.

7. The device of claim 1 wherein the means for retaining is fixedly attached to said door prop member.

8. The device of claim 1 wherein said door prop member is shaped as a rectangular prism.

9. The device of claim 1 wherein said door prop member is shaped as a wedge.

* * * * *